United States Patent [19]

Smith

[11] Patent Number: 4,678,037

[45] Date of Patent: Jul. 7, 1987

[54] METHOD AND APPARATUS FOR COMPLETING A PLURALITY OF ZONES IN A WELLBORE

[75] Inventor: Michael B. Smith, Tulsa, Okla.

[73] Assignee: Amoco Corporation, Chicago, Ill.

[21] Appl. No.: 806,254

[22] Filed: Dec. 6, 1985

[51] Int. Cl.[4] ..... E21B 29/02

[52] U.S. Cl. ..... 166/299; 166/376

[58] Field of Search ..... 166/281, 299, 376, 387

[56] References Cited

U.S. PATENT DOCUMENTS

| | | | |
|---|---|---|---|
| 3,020,954 | 2/1962 | Graham et al. | 166/281 |
| 3,690,379 | 9/1972 | Bullen | 166/299 |
| 4,374,543 | 2/1983 | Richardson | 166/376 X |

*Primary Examiner*—Stephen J. Novosad
*Assistant Examiner*—Thomas J. Odar
*Attorney, Agent, or Firm*—Scott H. Brown; Fred E. Hook

[57] ABSTRACT

Method and apparatus for completing a plurality of zones in a wellbore. A packer having a tubular element extending therethrough is suspended in a wellbore between two hydrocarbon-bearing zones of interest. The lower zone is perforated and stimulated if necessary. Thereafter, the tubular element is sealed with a plug which includes an explosive charge and the upper zone is fractured and stimulated. The explosive is then detonated thus severing the tubular element at the plug thereby permitting production of formation fluids from both zones into a common string of tubing.

22 Claims, 7 Drawing Figures

METHOD AND APPARATUS FOR COMPLETING A PLURALITY OF ZONES IN A WELLBORE

BACKGROUND OF THE INVENTION

1. Field of the Invention

The present invention relates to methods and apparatus for permitting the flow of fluids from a plurality of fluid-bearing subterranean intervals or zones into a wellbore and, more particularly, to such methods and apparatus wherein adjacent zones are produced through a single casing within the wellbore.

2. Setting of the Invention

After an oil or gas well has been drilled and casing is cemented in the wellbore, it may be necessary or desirable to perforate the casing at several different levels in order to produce oil or gas from different fluid-bearing zones. Sometimes it may be necessary to produce each zone in isolation from the other; that is, concentric strings of production tubing are suspended in the casing with each string terminating at the level of the different zones. Annular seals or packers are set between the tubing strings to fluidically seal each zone from the others. Thereafter, formation fluids are produced from each zone through its associated tubing for use at the surface.

Often it is desirable to complete a well having a plurality of hydrocarbon-bearing zones through a single string of production tubing. In such cases, a string of production tubing is placed in the wellbore at a level immediately above the uppermost zone from which fluids are to be produced. A packer is used to seal the annulus between the tubing and the wellbore. Thereafter, a commercially available perforating device is lowered through the production tubing to various levels and is activated to perforate the selected zones. Fluids from the perforated formations are then produced through the casing and into the production tubing for use at the surface.

In some cases, it may be necessary to hydraulically fracture one or more zones as part of the completion process. A zone is hydraulically fractured by pumping a propping agent; e.g, sand, into the zone after the casing at that level has been perforated. It is often necessary to isolate a zone from the other zones prior to fracturing since each zone can require different quantities of propping agent at varying pressures for optimum results from the fracturing process. There are at least two known methods for fracturing multiple zones in a wellbore which are to be produced through a single string of production tubing.

In one method, a lower zone is first perforated and then fractured if necessary. Thereafter, a commercially available plug is lowered on a wireline and set in the wellbore above the fractured zone to seal it from the wellbore above the plug. A zone above the plug is then perforated and fractured. After fracturing the zone above the plug, the plug is retrieved from the wellbore or reset at a higher level in the wellbore to fracture another zone. During fracturing of the upper zone, sand settles on the top of the plug and oftentimes prevents its retrieval. The sand can be washed away by lowering tubing into the well and pumping fluids down the tubing to force the sand upwardly in the wellbore between the tubing and the casing. However, lowering such tubing to wash the sand away creates a problem in that the production tubing is opened to atmospheric pressure at the upper end of the well so it can be lowered.

This necessitates filling the well with heavy fluids, known as killing the well, to prevent high pressure flow from the formation into the wellbore which could cause a blowout while the tubing is in the wellbore. Killing the well is both expensive and time-consuming and poses a risk in that the formation's ability to produce fluids can be impaired by the absorption of the heavy fluids into the formation.

Another known procedure can be used to fracture a zone in a wellbore having a plurality of zones which are to be produced through a common tubing. In this procedure, a lower zone is fractured if necessary. The wellbore adjacent this zone is filled with sand while an upper zone is perforated and fractured. The sand about the lower zone prevents entry of the fracturing fluid and propping agent (injected into the wellbore during fracturing of the upper zone) from entering the lower zone. After fracturing the upper zone, the production tubing at the surface is opened sufficiently to permit well flow and, it is hoped, to remove the sand used to cover the lower zone along with the well fluids. If this is not so, tubing is lowered to wash away the sand, which necessitates killing the well, an undesirable procedure for other reasons mentioned above. Even if the sand is produced from the well along with the fluids, there can be problems caused by removing sand along with fluids. Such sand can damage chokes, valves, manifolds, and other production equipment.

There exists a need for a method and apparatus for completing a plurality of zones in a wellbore when one of the upper zones is hydraulically fractured. Moreover, there exists a need for such a method and apparatus which can be utilized without killing the well and without the other problems attendant with the above-described prior art methods and apparatus.

SUMMARY OF THE INVENTION

The present invention comprises a novel method and apparatus for completing a plurality of subterranean zones in a wellbore having at least an upper and a lower zone. The lower zone is first perforated and hydraulically fractured, then the upper zone is sealed from the lower zone. Thereafter, the upper zone is perforated and fractured and the seal between the zones is released, as by explosives.

More specifically, the present invention is particularly useful for completing a plurality of zones which are produced through a single string of tubing.

DETAILED DESCRIPTION OF THE PREFERRED EMBODIMENTS

The present invention provides a method and apparatus for completing, i.e., allowing fluid flow from, a plurality of subterranean fluid-filled zones in a wellbore having at least an upper and a lower zone. The lower zone is perforated and stimulated if necessary. Such stimulation can be either hydraulically fracturing or acidizing. Thereafter, a seal is created between the upper and lower zones and the upper zone is perforated and fractured. After the fracturing of the upper zone, the seal between the zones is released, such as by explosives. In one aspect of the invention, a detonating device on a wireline is lowered to a plug which is set between the upper and lower zones and on which an explosive is mounted. Thereafter the detonating device is activated to explosively destroy the seal between the upper and lower zones.

Figure 1:
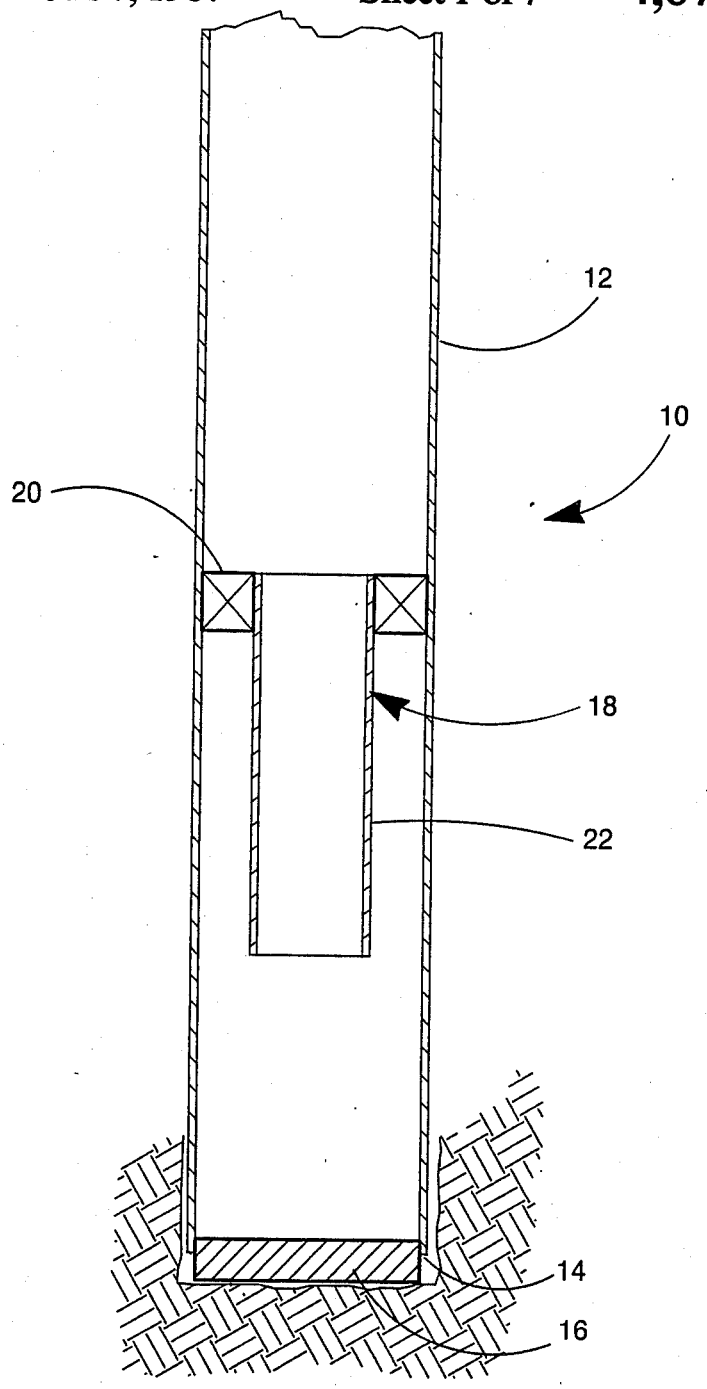
FIG. 1 is an elevational view of a portion of the preferred embodiment of the apparatus of the invention in a wellbore.

Turning now to the drawings, and particularly to FIG. 1, indicated generally at 10 therein is a well which has been drilled for the production of hydrocarbon fluids. Included therein is a casing 12 which is cemented in the wellbore, as is known to those skilled in the art. The casing extends upwardly to the surface of the well (not shown in FIG. 1) and downwardly to a lower end 14 which can be adjacent the bottom of the wellbore. Lower end 14 is plugged and cemented in a known fashion with a plug 16 to isolate the interior of the casing from the surrounding fluids.

Suspended in casing 12 is a packer assembly 18. A packer 20 is included in the packer assembly 18 and comprises an annular elastomeric seal between casing 12 and a tubular element or pipe 22, which can be called a tail pipe. Pipe 22 is open at its upper and lower ends and thus fluid in the casing can flow through pipe 22, but not through the annulus between the pipe and the casing.

Figure 2:
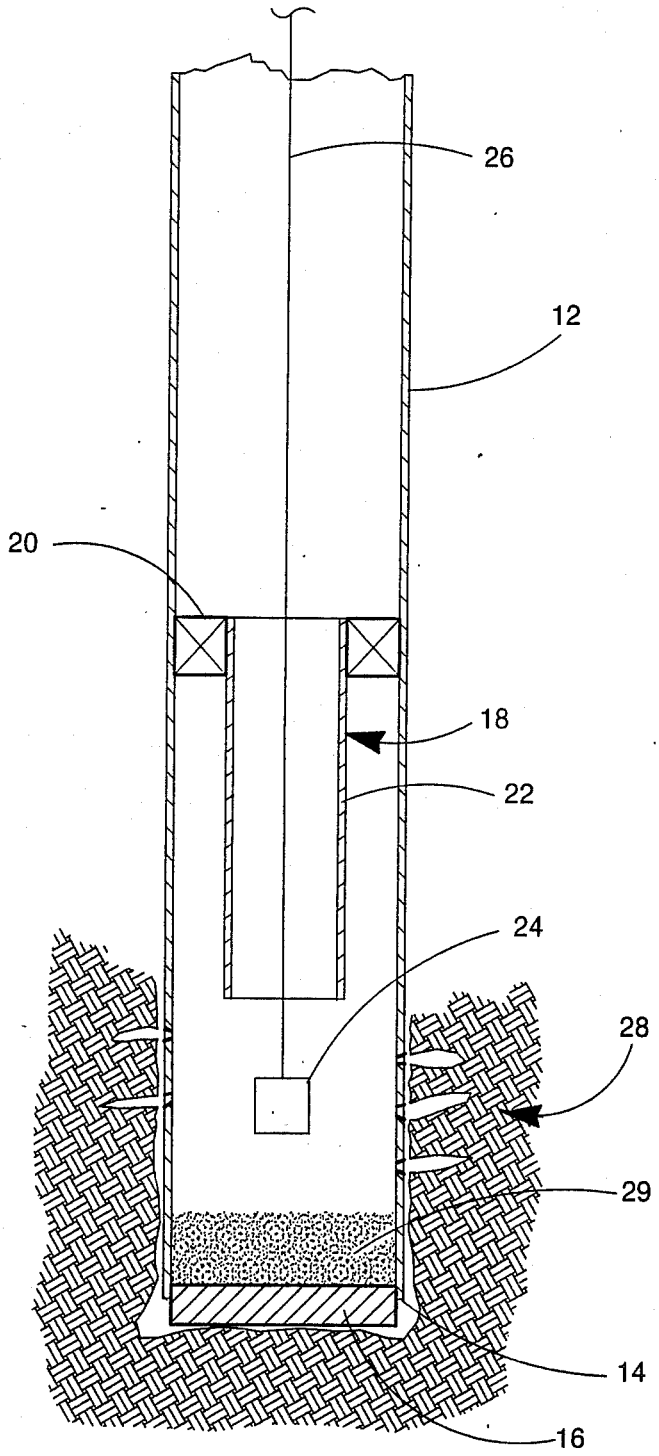
FIG. 2 is a view similar to FIG. 1 after perforating and fracturing a lower zone.

Turning now to FIG. 2, a commerically-available perforator 24 is suspended, such as by a wireline 26, inside casing 12. The perforator is used to produce holes or perforations, indicated generally at 28, through casing 12 into a lower zone in the formation surrounding the casing. Perforator 24 is in effect a gun which fires projectiles at the interior of the casing, thus creating the perforations. After the perforator 24 has been activated, sand 29 is caused to be deposited on plug 16 as shown following an hydraulic fracturing operation which will be later described.

Figure 3:
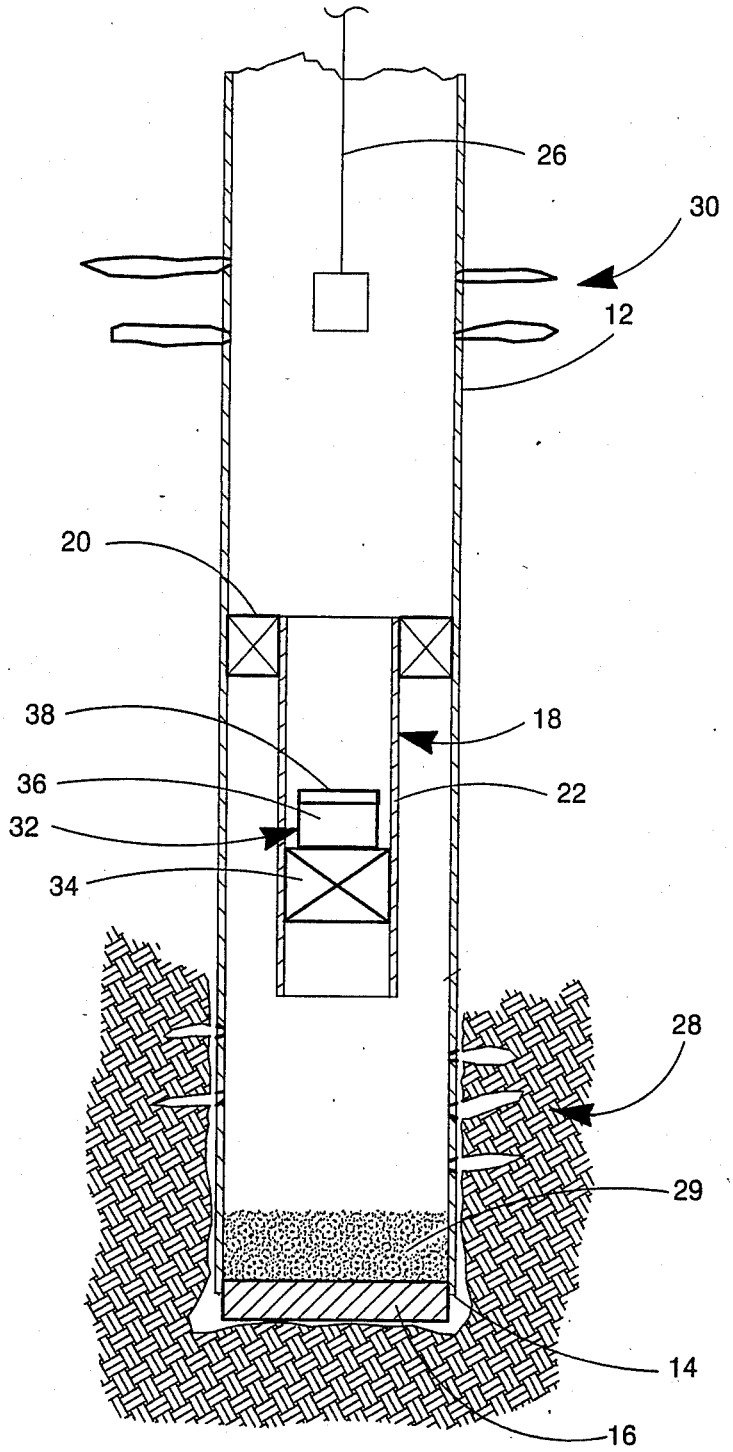
FIG. 3 is a view similar to FIG. 2 after perforating an upper zone and showing additional structure of the preferred embodiment of the invention.

Turning now to FIG. 3, indicated generally at 30 are perforations made by perforator 24 through casing 12 into an upper zone in the formation surrounding the casing. A plug 32 received within pipe 22 is shown in schematic form and includes therein an elastomeric seal 34 which prevent fluid transmission through pipe 22. Mounted on seal 34 is a commercially available explosive 36 and a commercially available detonator 38 is attached to explosive 36. Detonator 38 reacts in response to a signal from a commercially available detonating device (not shown in FIG. 3) to cause explosive 36 to explode.

Figure 4:
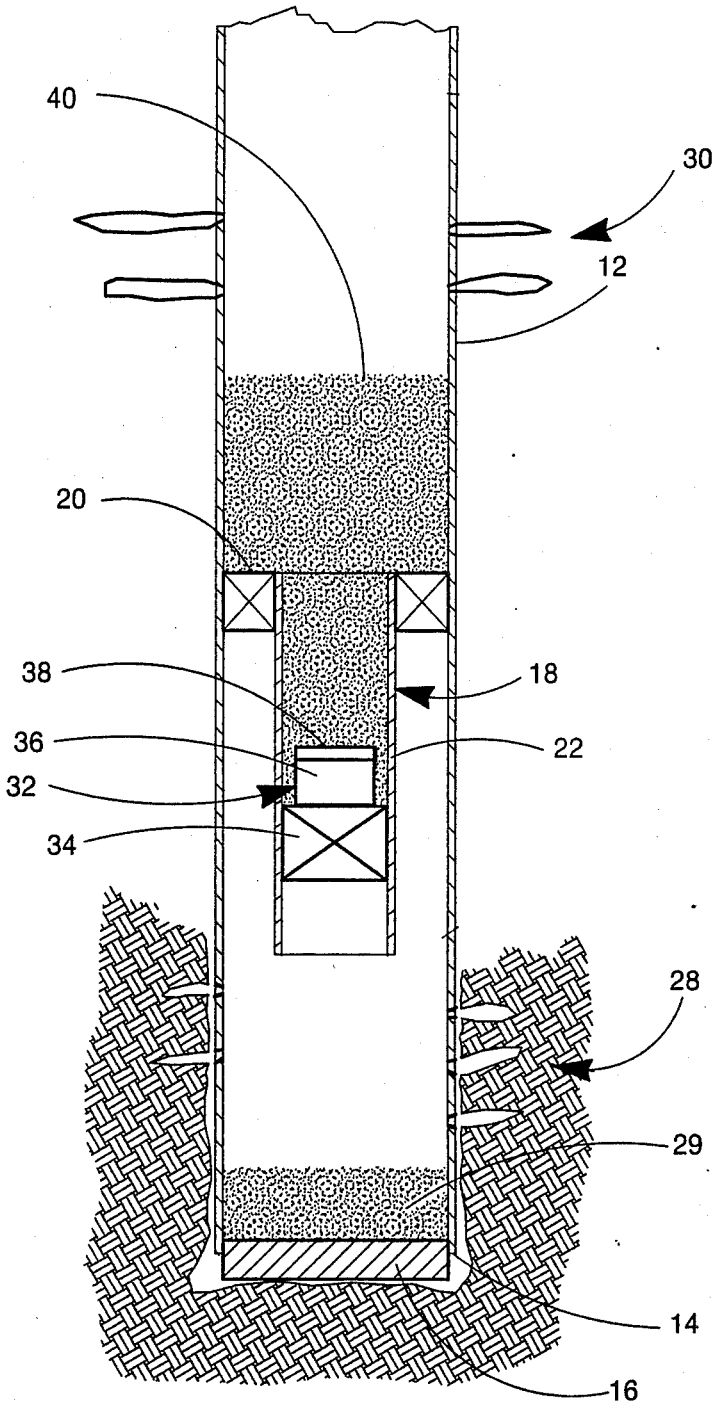
FIG. 4 is a view similar to FIG. 3 after fracturing of the upper zone.
Figure 5:
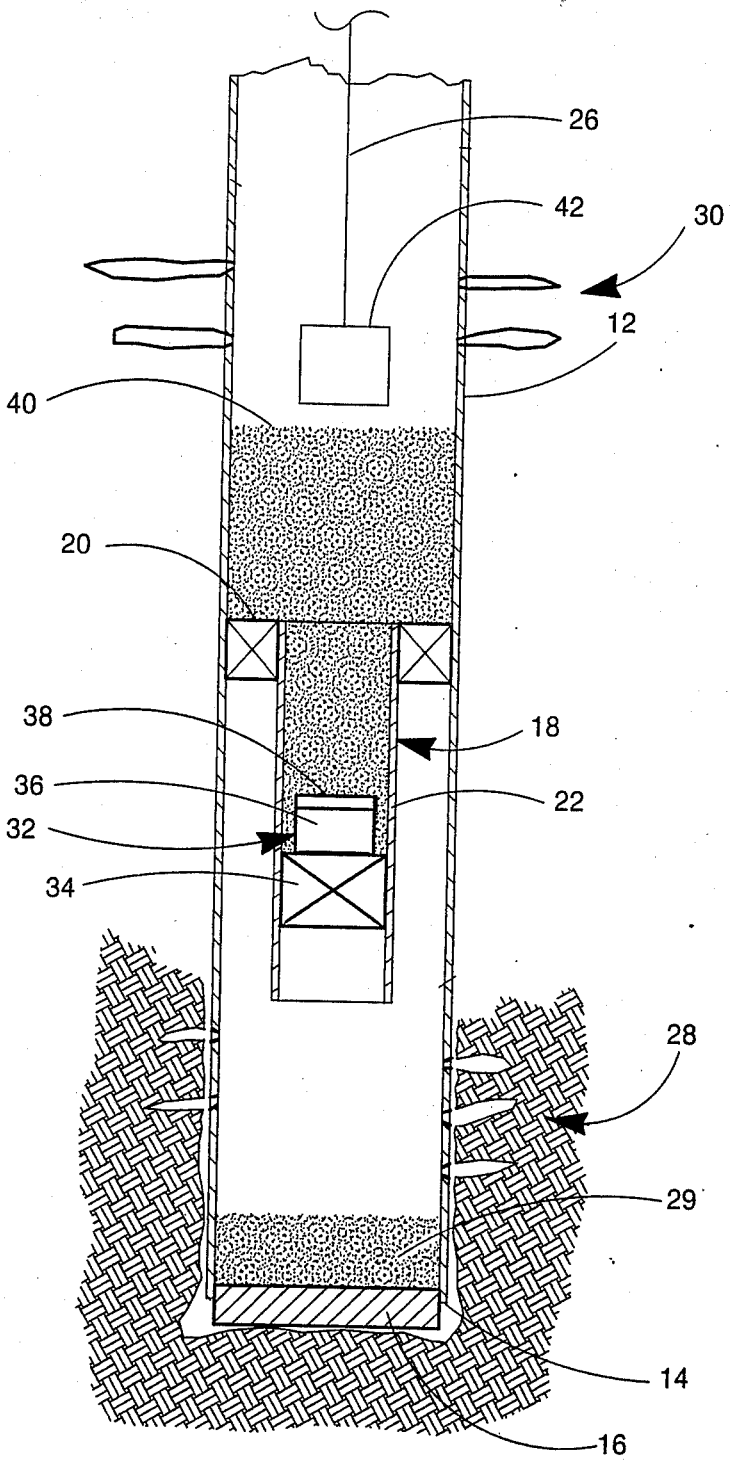
FIG. 5 is a view similar to FIG. 4 showing additional structure of the preferred embodiment of the apparatus of the invention.

Turning now to FIG. 4, sand 40 is caused to be deposited on packer assembly 18 as shown following an hydraulic fracturing operation (to be hereinafter more fully described). A commercially available detonator 42 is suspended, such as from wireline 26, above sand 40 (FIG. 5) and is activated via electrical signals on conductors in wireline 26.

The description will now be made of the operation of the instant embodiment of the apparatus of the invention and of a preferred manner of performing the method of the invention. Turning first to FIG. 1, after the well is drilled and casing 12 and plug 16 are cemented in the wellbore, as shown in FIG. 1, a tubing string with a commercially available packer tool suspended therefrom is used to set packer assembly 18 in the wellbore (FIG. 1). Thereafter, the tubing string and tool are removed from the wellbore and a string of production tubing (not visible in the drawings) is lowered into the wellbore and a packer, similar to packer 20, is used to seal the annulus between the production tubing and casing 12. The upper end of the production tubing extends from the well at the surface and is fitted with commercially available production equipment which allows a wireline with a tool suspended therefrom to be lowered into the wellbore without exposing the upper end of the production tubing to atmospheric pressure. In other words, whatever pressure exists in the wellbore beneath the production tubing is maintained at its ambient level. The lower end of the production tubing terminates in the wellbore above perforations 30.

After the production tubing and its associated equipment are in position, perforator 24 (FIG. 2) is lowered on a wireline 26 and perforations 28 are created in the usual manner. Thereafter the perforator 24 is removed from the wellbore. At this point, the lower zone is stimulated if needed. One type of stimulation, hydraulic fracturing, is achieved by pumping a sand and fluid mixture into the wellbore at the surface and thence into the formation via the casing perforations. Such stimulation has been performed in FIG. 2 and some sand 29, which did not enter the formation via perforations 28, is deposited at the bottom of the wellbore. After stimulation, a postfracture cleanup flow is permitted, achieved by opening the production tubing at the surface and permitting fluid pressure in the formation to force fracturing fluids in the wellbore to flow from the well at the surface. Thereafter, plug 32 is suspended from a commercially available tool on wireline 26 and lowered into the wellbore. The plug is lowered into pipe 22 and set in the pipe as shown in FIG. 3. After plug 32 is set, wireline 26 is returned to the surface and perforator 24 is again suspended from the wireline. Thereafter the perforator is lowered to the position shown in FIG. 3 and is activated to create perforations 30. After perforations 30 are created, perforator 24 is raised to the surface via wireline 26 and the formation adjacent perforations 30 is hydraulically fractured. As in fracturing the lower zone, fluid mixed with sand is pumped under pressure into the wellbore and through perforations 30 into the surrounding formations. In FIG. 4, some of the sand 40 has settled on packer assembly 18 as shown. After fracturing is complete, the well is opened to permit a postfracture cleanup flow through perforations 30 to remove sand and debris.

After the cleanup flow, detonating device 42 (in FIG. 5) is lowered on the wireline to a point just above sand 40. The electrical conductors in wireline 26 are used to activate detonating device 42 which transmits a radio signal to detonator 38 that causes explosive 36 to explode. It is to be appreciated that detonator 38 could be of the type which includes a timer that can be set at the surface of the well, thus eliminating the need for detonating device 42.

Figure 6:
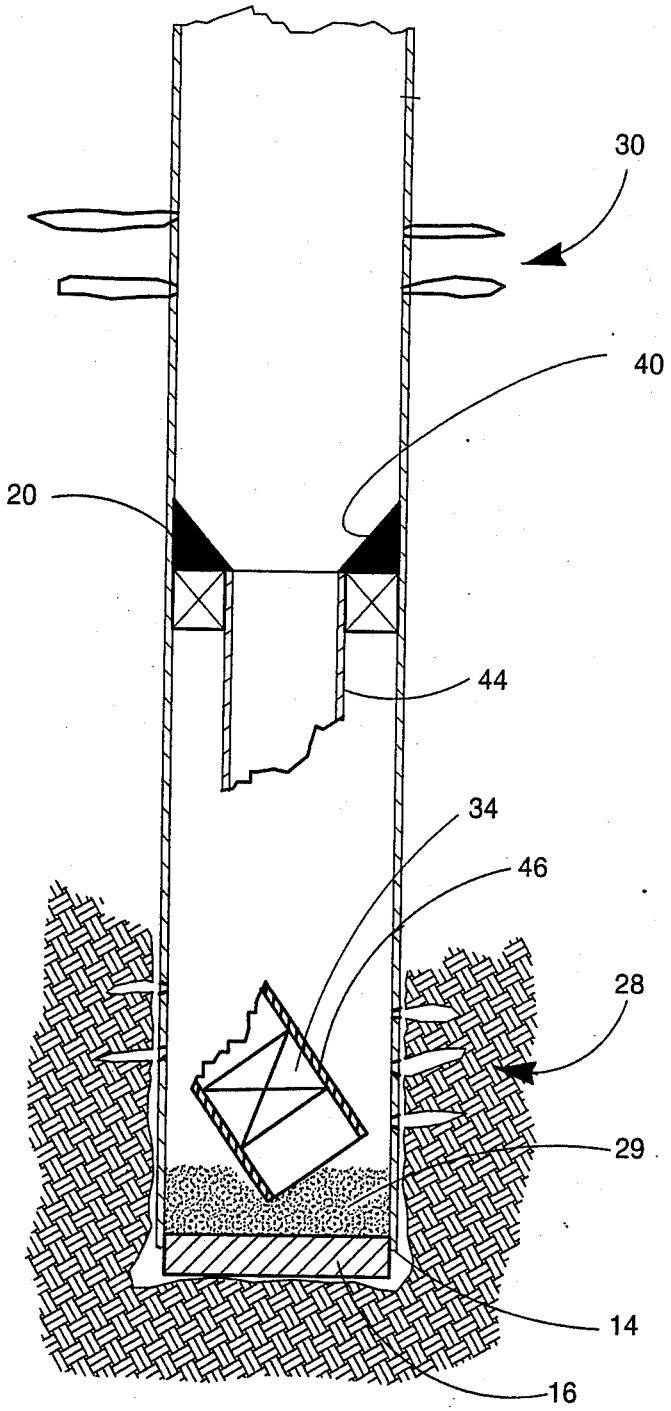
FIG. 6 is a view similar to FIG. 5 after performing additional steps of the method of the invention.

Turning now to FIG. 6, it can be seen that the explosion severs pipe 22 into an upper portion 44 and a lower portion 46 which falls to the bottom of the well. After the explosion, sand 40 flows through upper portion 44 into the bottom of the well, thus permitting formation fluids to flow from perforations 28 through upper portion 44 and thence upwardly, along with fluids from perforations 30, into the production tubing.

Figure 7:
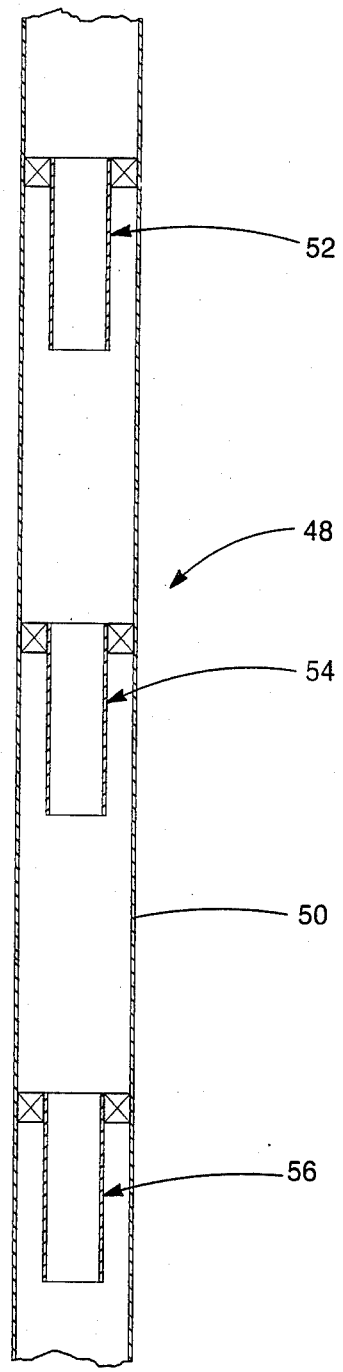
FIG. 7 is an elevational view of another wellbore showing portions of the preferred embodiment of the apparatus of the invention therein.

Turning now to FIG. 7, indicated generally at 48 is a well. Included therein is casing 50, like casing 12 in well 10. Packer assemblies 52, 54, and 54 are constructed like packer assembly 18 in well 10. In another manner for performing the method of the invention, the packer assemblies are suspended in well 48 in the same way that packer assembly 18 is suspended in well 10. Thereafter, perforation and fracturing of a zone beneath assembly 56 is performed in the manner previously described. The pipe in assembly 56 is then sealed with a plug, like plug 32, and the zone between assemblies 54 and 56 is perforated and fractured. Thereafter, plugging, perforating, and fracturing proceeds up the wellbore as previously described. After all perforation and fracturing is complete, all of the explosives are simultaneously detonated thus permitting flow from each of the perforated formations into the casing and up the wellbore.

It is also possible to explode the plug, like plug 32, in assembly 56 immediately after perforating and fracturing the zone between assemblies 54, 56. Thereafter, a plug, like plug 32, is set in assembly 54 and the zone between assemblies 52, 54 is fractured and perforated. The plug in assembly 54 is then exploded, cleanup flow is permitted and a plug is set in assembly 52 for perforation and fracture of the zone immediately thereabove. Such continues until all zones are perforated and fractured after which the well is ready for production.

Thus the present invention is well adapted to obtain the advantages mentioned, as well as those inherent therein. It is to be appreciated that revisions or modifications may be made to the methods and apparatus disclosed herein without departing from the spirit of the invention which is defined in the following claims.

What is claimed is:

1. A method for permitting fluid flow from a plurality of subterranean zones into a wellbore, there being at least an upper and lower perforated zone, comprising the steps of:

perforating the lower zone;

creating a seal in the wellbore between the upper and lower zones prior to perforating the upper zone to allow fracturing of the upper zone without establishing fluid communication with the lower zone;

perforating the upper zone;

fracturing the upper zone; and explosively releasing the seal between said upper and lower zones without fracturing the formation in either zone.

2. The method of claim 1 wherein said method further includes the step of hydraulically stimulating the lower zone after perforating the lower zone and prior to creating a seal between the upper and lower zones.

3. The method of claim 2 wherein said method further includes the step of permitting flow from the wellbore after hydraulically stimulating the lower zone and prior to creating a seal between the upper and lower zones.

4. The method of claim 1 wherein said method further includes the step of sealing the wellbore above the upper zone prior to perforating the upper zone.

5. The method of claim 1 wherein said method further includes the step of permitting flow from the wellbore after fracturing the upper zone and before explosively destroying the seal between said upper and lower zones.

6. The method of claim 1 wherein the step of explosively destroying the seal between said upper and lower zones comprises the steps of lowering an explosive to the seal between the upper and lower zones and detonating the explosive.

7. The method of claim 6 wherein the steps of creating a seal between the upper and lower zones and lowering an explosive to the seal between the upper and lower zones are performed substantially simultaneously.

8. The method of claim 6 wherein the step of detonating the explosive comprises the steps of lowering a detonating device into the wellbore adjacent the explosive and activating the detonating device.

9. An apparatus for permitting fluid flow from a plurality of subterranean zones into a wellbore, there being at least an upper and a lower perforated zone, said apparatus comprising:

means for creating a seal in the wellbore between said upper and lower zones prior to perforating the upper zone; and means for explosively destroying the seal without fracturing the formation in either zone.

10. The apparatus of claim 9 wherein said means for explosively destroying such a seal comprises:

means for lowering an explosive to such a seal; and means for detonating the explosive.

11. The apparatus of claim 9 wherein said means for creating a seal between said upper and lower zones comprises:

a packer having a tubular element extending therethrough; and means for creating a seal in said tubular element.

12. The apparatus of claim 11 wherein said means for explosively destroying such a seal comprises:

an explosive receivable within said tubular element; and means for detonating said explosive.

13. The apparatus of claim 11 wherein said means for explosively destroying such a seal comprises an explosive mounted on said means for creating a seal in said tubular element.

14. A method for permitting fluid flow into a wellbore from at least an upper and lower perforated zone, comprising the steps of:

setting a packer, having a tubular element extending therethrough, in the wellbore between said zones;

perforating the lower zone;

creating a seal prior to perforating the upper zone in said tubular element;

lowering an explosive into said tubular element;

perforating the upper zone;

fracturing the upper zone; and detonating the explosive without fracturing the formation in either zone.

15. The method of claim 14 wherein said method further includes the step of hydraulically stimulating said lower zone after perforating the lower zone and prior to creating a seal in said tubular element.

16. The method of claim 15 wherein said method further includes the step of permitting flow from the wellbore after hydraulically stimulating said lower zone and prior to creating a seal in said tubular element.

17. The method of claim 14 which further includes the step of sealing the wellbore above said upper zone after setting the packer in the wellbore between said zones.

18. The method of claim 14 wherein said method further includes the step of permitting flow from the wellbore after fracturing said upper zone and before detonating the explosive.

19. The method of claim 14 wherein the step of detonating the explosive comprises the steps of lowering a detonating device into the wellbore adjacent the explosive and activating the detonating device.

20. The method of claim 14 wherein the steps of creating a seal in said tubular element and lowering an explosive into said tubular element are performed substantially simultaneously.

21. An apparatus for completing a plurality of zones in a wellbore having at least an upper and a lower zone, said apparatus comprising;

a packert having a tailpipe assembly extending therethrough, means for sealing said tailpipe assembly from fluid flow through a wellbore; and means for explosively releasing said sealing means without fracturing the formation in either zone.

22. The apparatus of claim 21 wherein said apparatus further includes:

a detonating device for detonating such an explosive; and means for lowering said detonating device into a wellbore.

* * * * *